United States Patent [19]

Hara

[11] Patent Number: 4,479,601

[45] Date of Patent: Oct. 30, 1984

[54] HYDRAULIC RIVET DRIVER

[75] Inventor: Kunio Hara, Kawasaki, Japan

[73] Assignee: Nifco Inc., Yokohama, Japan

[21] Appl. No.: 529,442

[22] Filed: Sep. 6, 1983

[30] Foreign Application Priority Data

Sep. 7, 1982 [JP] Japan ..... 57-154560

[51] Int. Cl.[3] ..... B21J 15/02

[52] U.S. Cl. ..... 227/130; 227/136; 227/147

[58] Field of Search ..... 72/391, 453.01, 453.18, 72/453.17, 453.19, 114; 227/130, 146, 147

[56] References Cited

U.S. PATENT DOCUMENTS 2,854,953 10/1958 Osborne ..... 227/130
4,183,239 1/1980 Stubbings ..... 72/391

FOREIGN PATENT DOCUMENTS 961453 1/1975 Canada ..... 72/391
2714504 2/1978 Fed. Rep. of Germany ..... 72/391

*Primary Examiner*—E. Michael Combs
*Assistant Examiner*—Charles Rosenberg
*Attorney, Agent, or Firm*—J. R. Halvorsen; T. W. Buckman

[57] ABSTRACT

A rivet driver for easily fastening a rivet comprising a male shank and a female tube to separate members has a construction such that the separate members may be united by hydraulically driving the male shank into the female tube to thereby cause the female tube to be radially expanded outwardly and that upon completion of this hydraulic driving, it feeds a subsequent rivet to the supply position and is ready for next driving of the male shank into the female tube of the subsequent rivet.

3 Claims, 16 Drawing Figures

FIG. 1
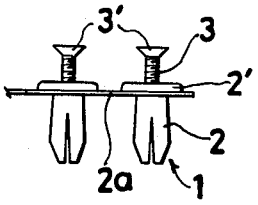
FIG. 3
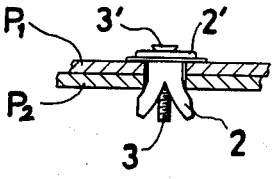
FIG. 2
FIG. 4
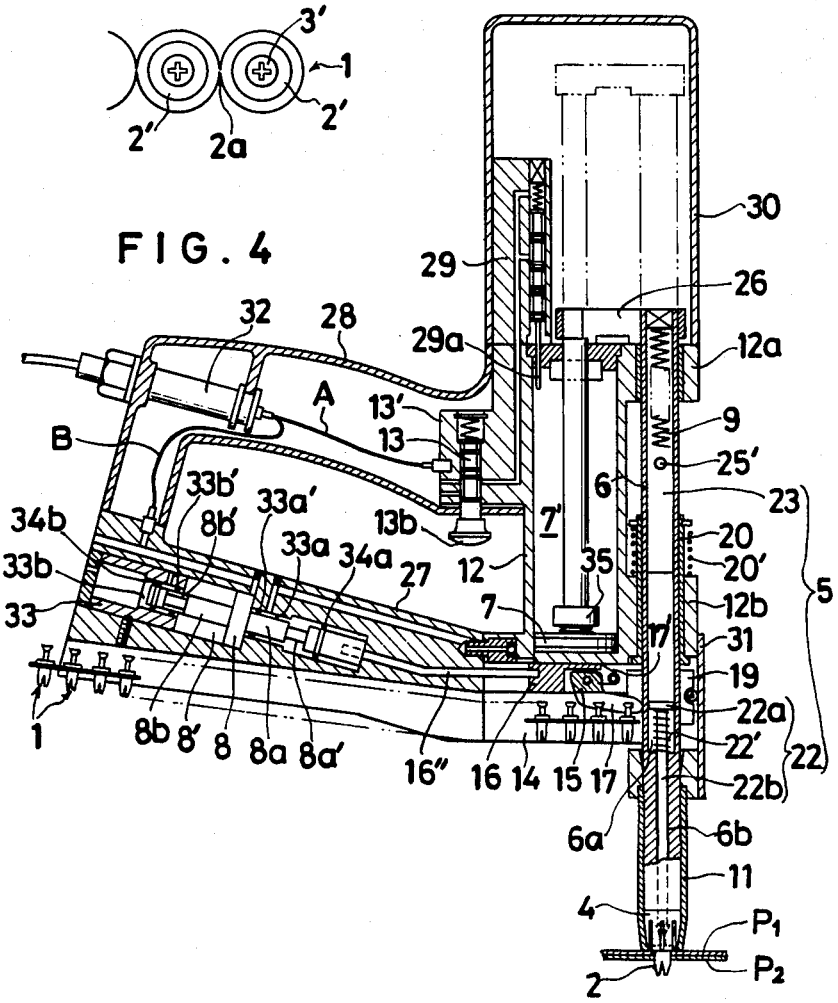

HYDRAULIC RIVET DRIVER

BACKGROUND OF THE INVENTION

1. Field of the Invention

This invention relates to a rivet driver for uniting a plurality of plates in a superposed state or for attaching a part to a plate, by driving a rivet therethrough.

2. Description of Prior Art

U.S. Pat. No. 4,131,009 and Japanese Patent Application Disclosure Sho 53(1978)-18069 propose rivet drivers of the type described above. The rivet used with rivet driver disclosed in the U.S. patent comprises a female tube and a male shank upwardly passed inseparably through the female tube so that separate members can be united by inserting the whole rivet through aligned holes in the superposed members, forcibly pulling out the male shank while holding the flange at the upper end of the female tube pressed against the uppermost surface of the superposed members thereby causing the female tube to be radially bent outwardly, and consequently nipping the superposed members between the bent portion of the female tube and the lower side of the flange. Although the rivet driver according to the U.S. patent is hydraulically operated, it cannot be used with a rivet which is designed to unite separate members by driving a male shank into a female tube thereby causing the female tube to be expanded outwardly against the inner walls of the holes in the members.

The rivet driver disclosed in the Disclosure is designed for use with a rivet which unites separate members by driving a male shank into a female tube thereby causing the female tube to be radially expanded outwardly. Since this driver makes use of the force of a spring instead of the pressure of a fluid, it does not operate lightly. The worker using this driver, therefore, is required to exert much energy in operating it so that the work becomes very laborious.

SUMMARY OF THE INVENTION

The object of this invention is to provide a hydraulically operated rivet driver for easily fastening a rivet constructed to unite separate members by driving a male shank into a female tube thereby causing the female tube to be radially expanded outwardly.

To accomplish the object described above according to the present invention, there is provided a rivet driver which comprises an actuating cylinder provided at the lower end thereof with a chuck for nipping a rivet and incorporating therein a hammer lever for delivering a downword stroke upon the rivet, means for causing the frontmost of a plurality of rivets sequentially arranged in a row to be pushed out into the supply position below the chuck when the actuating cylinder completes its ascent, means for suspending the descent of the hammer lever during the descent of the actuating cylinder and contracting a spring accommodated inside the actuating cylinder owing to the continued descent of the actuating cylinder, means for enabling the chuck at the lower end of the actuating cylinder to nip the frontmost of the plurality of rivets arranged in a row while the actuating cylinder is descending, tear the frontmost rivet from the rest of the row of rivets owing to the further descent of the actuating cylinder, insert the female tube of the rivet into the coinciding holes of the superposed panels when the actuating cylinder completes its descent, subsequently release the hammer lever and make it to fall at a high speed onto the male shank by virtue of the elastic force exerted by the spring released from the restraint and drive the male shank into the female tube thereby causing the shell of the female tube to be expanded radially outwardly and pressed against the inner walls of the holes.

The other objects and characteristics of the present invention will become apparent from the further disclosure of the invention to be given hereinafter with reference to the accompanying drawings.

BRIEF DESCRIPTION OF THE DRAWINGS

FIG. 1 is a side view illustrating interlinked rivets of the type used with the rivet driver of the present invention.

FIG. 2 is a plan view of the rivets of FIG. 1.

FIG. 3 is a cross-sectional view illustrating two panels fastened by a rivet of the type shown in FIG. 1.

FIG. 4 is a cross-sectional side view illustrating one embodiment of the rivet driver of the present invention in a state ready for driving a rivet.

DESCRIPTION OF PREFERRED EMBODIMENT

Figure 5:
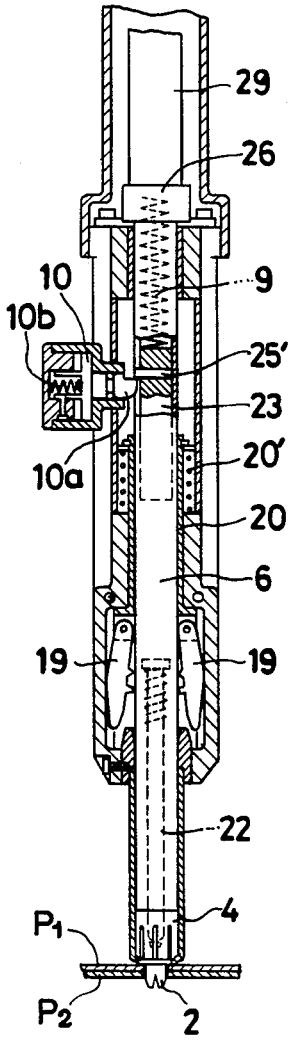
FIG. 5 is a cross-sectional front view of the rivet driver of FIG. 4.

The rivet driver of this invention will be described below with reference to one embodiment illustrated in the attached drawings. Preparatory to this description, the rivet used with the rivet driver of this invention will be explained. The rivet 1 comprises a female tube 2 provided with a flange 2' and a male shank 3 having the lower end thereof inserted to a small depth into the female tube (FIGS. 1 and 2). When the female tube 2 is passed through coinciding holes formed in advance through a plurality of panels $P_1$, $P_2$ to be united in a superposed manner until the flange 2' is received fast on the uppermost surface of the superposed panels and the male shank 3 is subsequently driven home into the female tube, the lower half of the female tube which is radially divided into a plurality of segments by slits has the plurality of segments radially opened in the pattern of petals of a flower to unite the panels $P_1$, $P_2$ in a superposed state (FIG. 3). In the illustrated embodiment, the male shank 3 is provided at the upper end thereof with a head 3' so that it can be driven into the female tube until the lower surface of this head 3' comes into fast contact with the upper surface of the flange 2'. The head 3' may be omitted as occasion permits. In the illustrated embodiment, the male shank 3 and the female tube 2 are separately formed and the male shank 3 is inserted only to a small depth into the female tube 2. Optionally, they may be integrally molded with the lower end of the male shank 3 joining the upper edge of an inner hole opening in the upper surface of the flange 2' through a readily breakable connecting part. Further in the illustrated embodiment, the male shank 3 is provided on the periphery thereof with a male thread and the female tube 2 on the inner wall thereof with a female thread. Owing to the provision of these threads, the panels $P_1$, $P_2$ which have been united with the rivet may be separated from each other by rotating the male shank 3 in a loosening direction until the male shank 3 is completely released from the inner wall of the female tube 2. Of course, these threads may be omitted as occasion demands. In any event, it suffices to have a plurality of such female tubes 2 molded side by side with their respective flanges 2' connected with readily breakable connecting parts 2*a*.

The rivet driver of this invention is provided with a vertically movable actuating cylinder 6 having at the lower end thereof a chuck 4 adapted to firmly hold the circumference of the aforementioned flange 2' of the rivet 1 or the portion of the male shank 3 upwardly protruding above the flange, and incorporating therein a built-in hammer lever 5 adapted to strike downwardly the male shank 3, a main piston 7 serving to confer a vertical motion upon the actuating cylinder 6, a feed piston 8 serving to push out the frontmost of a row of interlinked rivets to the feed position below the chuck 4 at the lower end of the actuating cylinder 6 when the main piston 7 has raised the actuating cylinder 6 to the uppermost end of its vertical stroke, and a striker piston 10 serving to catch hold of the hammer lever 5 in the actuating cylinder 6 during the descent of the actuating cylinder 6 and consequently causing a spring 9 to be compressed between the upper end of the actuating cylinder 6 and the upper end of the hammer lever 5 owing to the subsequently continued descent of the actuating cylinder 6, so that when the actuating cylinder 6 nears the bottom of its descent the chuck 4 at the lower end thereof will firmly grasp either the flange 2 or the portion of the male shank 3 protruding above the flange 2' of the frontmost rivet pushed out by the feed piston 8 and, at the same time, tear the frontmost rivet from the remaining row of rivets by the force of its descent and, on reaching the bottom of its descent, cause the portion of the female tube 2 of the rivet extending downwardly from the flange 2' to thrust out of the lower end of a stationary guide cylinder 11 having the actuating cylinder 6 fitted firmly on the inner wall thereof. When the female tube 2 protruding from the lower end of the guide cylinder 11 is passed through a series of coinciding holes formed through the panels $P_1$, $P_2$ until the lower surface of the flange 2' is pressed against the uppermost surface of the superposed panels (FIG. 5) and the striker piston 10 releases the hammer lever 5, therefore, the hammer lever 5 will be rapidly lowered by the force of the spring 9 compressed on the upper end of the hammer lever 5 and, on reaching the bottom of its descent, strike the male shank 3 powerfully enough to drive the male shank 3 into the female tube 2 and consequently causing the female tube 2 to be radially expanded outwardly (FIG. 6).

Figure 10:
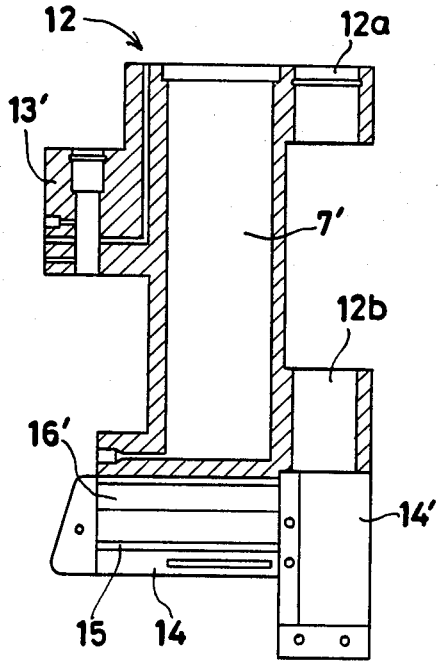
FIG. 10 is a cross-sectional side view of the mainbody block of the rivet driver.
Figure 11:
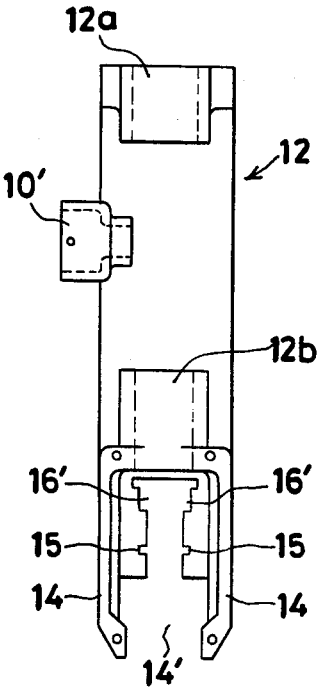
FIG. 11 is a front view of the main-body block of FIG. 10.
Figure 9:
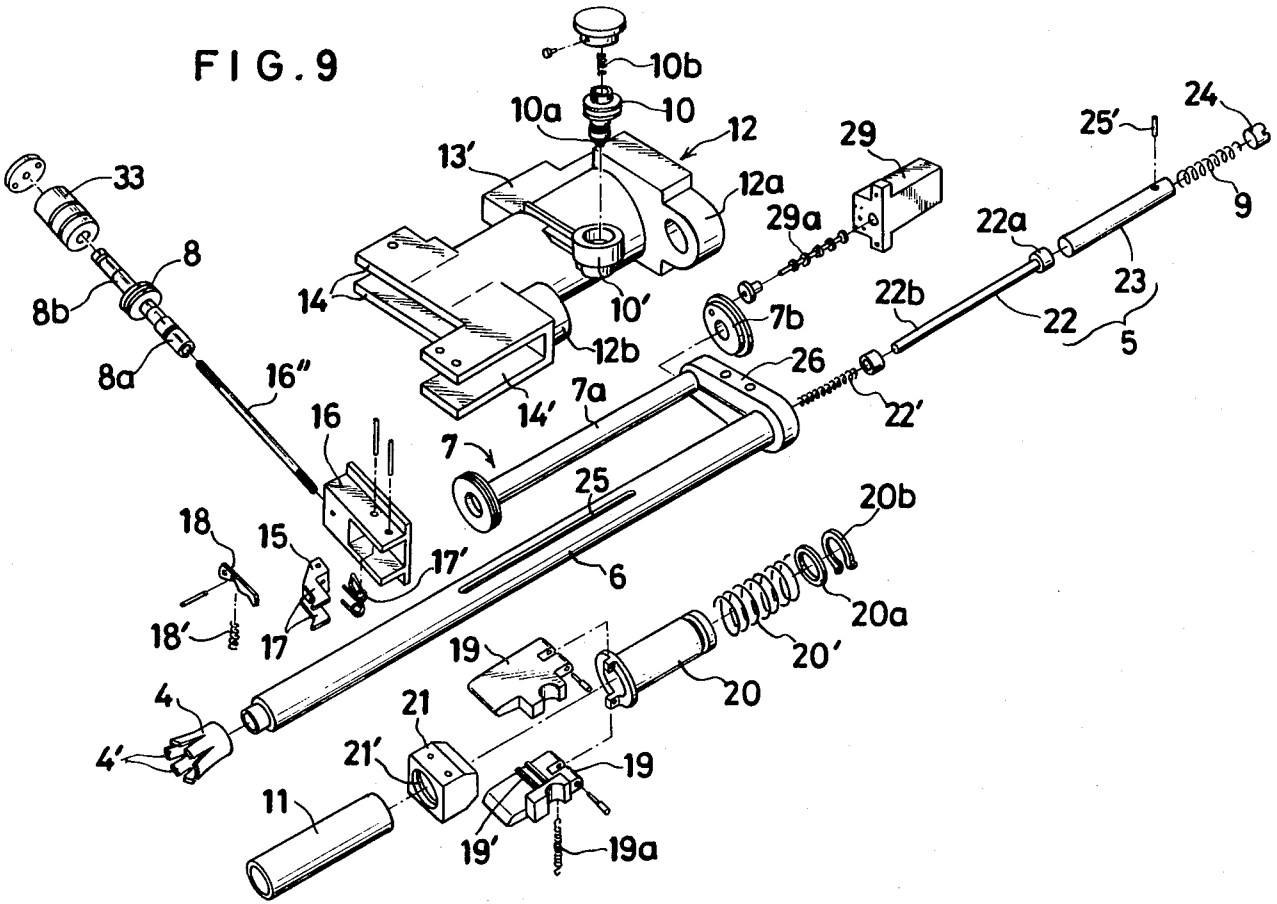
FIG. 9 is a perspective view of the rivet driver in an exploded state.

A main-body block 12 incorporates therein a cylinder 7' for the main piston 7 (FIGS. 10 and 11) and is provided with guide cylinders 12*a*, 12*b* projected from the upper and lower portions of one lateral side thereof for the purpose of guiding the actuating cylinder 6 and with a cylinder 10' for the striker piston 10 disposed laterally toward the space intervening between the aforementioned guide cylinders 12*a*, 12*b*. From the lower end of the main-body block 12, opposed lateral walls 14 are projected parallelly to each other. On the inner surfaces of the lateral walls 14 which are opposed to each other below the cylinder 7', there are provided grooves 15 for guiding the flanges 2' of the rivets arranged in a continuous row and, at a higher level, sliding grooves 16' for a guiding slider 16 which is reciprocated by the feed piston 8 for the purpose of pushing out to the feed position one rivet after another from the row of rivets. The space below the lower guide cylinder 12*b* constitutes a cavity 14' for accommodating a lateral pair of support pieces 19 for supporting at the opposed sides the flange 2' of the frontmost rivet 1 pushed out to the feed position.

To the slider 16 is pivotally attached a feed claw 17 serving to interpose the tip of the claw thereof between the flanges of the two frontmost rivets straddling the male shanks 3 of the rivets 1. This feed claw 17 is adapted to be swung upwardly against a spring 17' and consequently allowed to slip backwardly over the flange 2' of the second rivet 1 and drop the tip thereof between the flanges of the second and third rivets while the feed piston 8 is in the process of retracting the slider 16 after the hammer lever 5 has driven the frontmost rivet and the main piston 7 has elevated the actuating cylinder 6. Subsequently when the slider 16 is advanced in the same amount by the piston 8, the feed claw 17 pushes the row of rivets forwardly, causing the second rivet 1, now in the place of the frontmost rivet, to be brought into the feed position and supported on the support pieces 19. One of the lateral walls 14 may be provided on the inner wall thereof with a stopper 18 having the free end thereof pressed by a spring 18' against the inner wall of the other lateral wall 14 so that when the row of rivets is manually pushed in along the grooves 15 to be set in position, the stopper 18 will be pushed back by the frontmost of the row of rivets enough to permit passage of the frontmost rivet and, on completion of this passage, the stopper 18 will be caused by the pressure of the spring 18' to resume its original position between the female tubes of the two frontmost rivets and prevent the frontmost rivet from being returned backwardly. The frontmost rivet is pushed out to the feed position by one blank strike of the rivet driver and, consequently, the stopper 18 is pushed back by the second rivet enough to permit passage of the second rivet and, on completion of the passage, is returned to its original position to prevent the second rivet from being returned backwardly. Since the functions of the slider 16 and the stopper 18 are substantially the same as those described in the aforementioned U.S. Pat. No. 4,131,009, further description thereof is omitted here to avoid redundancy.

Figure 7:
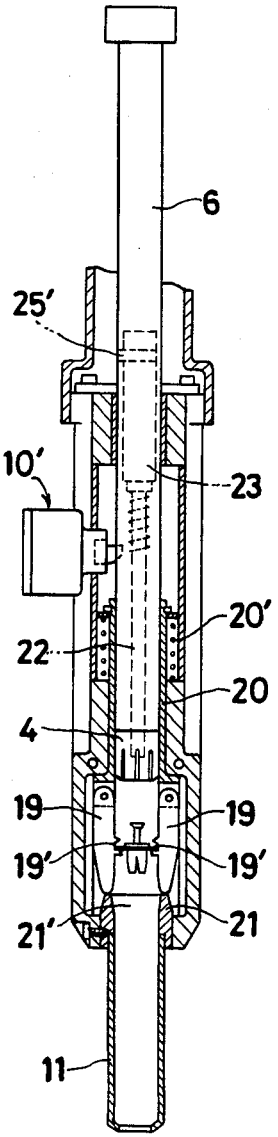
FIG. 7 is a cross-sectional front view illustrating the rivet driver with the main piston thereof held at the uppermost end of its vertical stroke.
Figure 8:
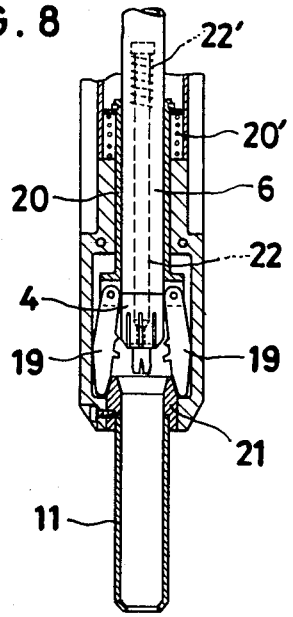
FIG. 8 is a cross-sectional front view illustrating the rivet driver with the main piston in the process of its descending stroke.
Figure 12:
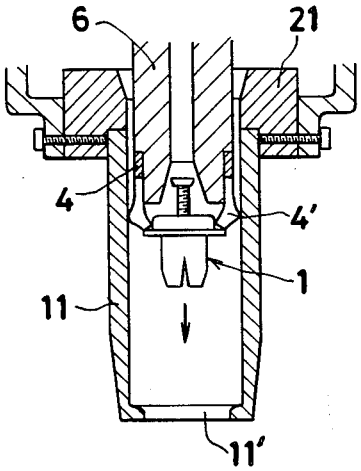
FIG. 12 is a cross-sectional front view illustrating the rivet driver at the time its chuck descends with a rivet firmly held thereby.
Figure 13:
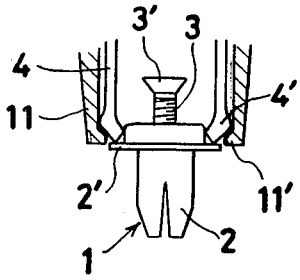
FIG. 13 is a cross-sectional view illustrating the chuck of FIG. 12 at the lowermost end of its stroke.

Laterally paired support pieces 19 for supporting in position the frontmost rivet which has been pushed out to the feed position are swingably suspended from the lower end of a holder tube 20 slidably inserted in the vertical direction through the lower guide cylinder 12*b* and urged upwardly by a spring 20'. These support pieces 19 are provided on the opposed inner surfaces thereof with paired support grooves 19' communicating with the grooves 15 and serving to support the flange 2' of the frontmost rivet from the opposite sides (FIG. 7). In the lower portion of the cavity 14', a cam 21 provided at the center thereof with a perforation 21' for passing the actuating cylinder 6 is set fast between the lateral walls 14. The aforementioned guide tube 11 is suspended in position by having the upper end thereof thrust in and fastened to the lower half radially enlarged portion of the perforation 21'. This cam 21 is designed to separate the rivet from the support pieces 19. To be specific, when the lower end of the chuck 4 gives a downward push to the flange 2' of the frontmost rivet 1 while the actuating cylinder 6 is in the process of descent, the support pieces 19 go down in conjunction with the holder tube 20 in spite of the energizing force of the spring 20' and open in the downwardly diverging direction along the sloped surface of the cam 21, with the result that the flange 2' of the frontmost rivet will be released from the support grooves 19' (FIG. 8). Subsequently, the chuck 4 circumferentially nips either the portion of the male shank 3 protruding from the upper surface of the flange 2' or the flange 2' of the rivet, descends further and eventually tears the frontmost rivet from the row of rivets, and causes the portion of the female tube 2 extending downwardly from the flange 2' to be projected from the lower end of the guide cylinder 11. The chuck 4 is desired to have the lower end portion thereof divided by a plurality of circumferentially distributed slits as illustrated in FIGS. 12–13. The divided segments of the lower end portion of the chuck 4 are provided on the outer sides thereof with protuberances 4'. The guide cylinder 11 is provided on the inner wall in the lower end portion thereof with an annular protuberance 11'. Consequently, the divided segments nip the male shank 3 or the flange 2' of the rivet 1 powerfully when the actuating cylinder 6 reaches the lowermost end of its descent, so that the chuck will not let go the rivet 1 when the female tube 2 of the rivet 1 is moved on the superposed panels preparatory to its insertion into the coinciding holes of the panels $P_1$, $P_2$. When the male shank 3 lacks the head 3' and the portion of the male shank extruding from the upper surface of the flange 2' constitutes a straight upward extension of the shank itself, the chuck 4 may be provided in the lower end portion thereof with a hole adapted to nip frictionally the upper end of the male shank 3.

The hammer lever 5 in the illustrated embodiment comprises a lower hammer lever 22 and an upper hammer lever 23. The lower hammer lever 22 is provided with a head 22*a* and a shank 22*b* extended downwardly from the center of the lower side of the head 22*a* and having substantially the same diameter as the male shank 3. The upper hammer lever 23 has substantially the same diameter as the head 22*a* of the lower hammer lever 22. The actuating cylinder 6 is provided in the lower portion thereof with a hole 6*b* of a small diameter for permitting passage therethrough of the aforementioned shank 22*b* and in the portion above the aforementioned lower portion with a hole 6*a* of a larger diameter for permitting passage therethrough of the head 22*a* and the upper hammer lever 23. The shank 22*b* of the lower hammer lever 22 which has a short spring 22' coiled thereon is inserted downwardly into the smaller hole 6*b* so that the head 22*a* may be kept buoyant by the spring 22' on the step formed by the boundary between the two holes 6*a*, 6*b*. The buoyancy thus conferred upon the lower hammer lever 22 by means of the spring 22' is necessary for the purpose of enabling the lower hammer lever 22 to be pressed down with the contraction of the spring 22' when the male shank 3 of the rivet 1 is driven in and, on completion of the driving of the male shank 3, allowing the lower hammer lever 22 to be lifted until the lower end thereof rises above the upper end of the male shank 3 of the rivet 1, so that the chuck 4 will safely nip the next rivet 1. After the lower hammer 22 has been inserted into the actuating cylinder 6, the upper hammer lever 23 and the spring 9 are subsequently inserted therein and a stopper 24 is helically driven into the upper end portion of the interior of the actuating cylinder 6.

The actuating cylinder 6 is provided in the central part of the lateral side thereof with a slit 25 opening in the direction of the striker piston 10. A pin 25' is passed through this slit 25 and fastened to the lateral side in the upper portion of the upper hammer lever 22, so that the upper hammer lever 22 may be reciprocated inside the actuating cylinder with the pin 25' moved along the slit 25. Although the hammer lever is divided into the upper and lower hammer levers in the illustrated embodiment, it may be formed so that the upper and lower hammer levers constitute one inseparable part. When the upper and lower hammer levers are formed separately as in the illustrated embodiment, there is the advantage that a plurality of upper hammer levers of dissimilar lengths and materials selected to give varying masses to the hammer levers may be used interchangeably for allowing the male shank 3 of the particular rivet 1 to be driven under the optimum condition.

After the hammer lever 5 and the spring 9 have been accommodated within the actuating cylinder 6, the actuating cylinder 6 is passed through the upper and lower guide cylinders 12*a*, 12*b*. Separately the main piston 7 is inserted into the cylinder 7' and a cylinder cover 7*b* is fitted around a piston rod 7*a* to close the upper end of the cylinder 7'. The upper end of the actuating cylinder 6 is connected to the upper end of the piston rod extending upward out of the cylinder cover 7*b* by a connecting member 26. The cylinder 10' accommodates the striker piston 10 and then is stoppered with a cover. In the illustrated embodiment, a striker 10*a* is integrally formed with the striker piston 10 so as to be projected from the bottom surface of the cylinder 10' and hooked on the pin 25' in the slit 25 of the actuating cylinder 6 and fastened to the upper hammer lever 23. The striker piston 10 has a spring 10*b* acting thereon in such a manner that the striker 10*a* is energized to be hooked on the pin 25'. The striker piston 10 may be provided with means for preventing the piston 10 from being rotated.

To the end portion of the main-body block 12 having the cavity 14' defined by the lateral walls 14, there is connected a rivet case 27 provided on the opposed lateral walls thereof with grooves communicating with the grooves 15. Inside the rivet case 27, a cylinder 8' for accommodating the feed piston 8 is formed in a lateral direction to receive therein the feed piston 8. A piston rod 8*a* is connected to the slider 16 through the medium of a connecting lever 16''. The slider 16 is slid substantially in a horizontal direction, whereas the feed piston 8 is moved in a slightly diagonal direction (FIG. 1). The connecting lever 16'' in this illustrated embodiment, therefore, possesses flexibility. The feed piston 8 is further provided with one more piston rod 8b in the direction opposite the rod 8a. The two rods 8a, 8b are provided near the leading ends thereof with portions 8a', 8b' of a smaller diameter and, therefore, concurrently serve as switch valves for pressurized fluid as will be fully described afterward.

The leading end of the rivet case 27 and the lateral portion of the main-body block 12 incorporating a cylindrical case 13' are connected to each other with an L-shaped grip 28 and, at the same time, an operating valve 13 is fitted in the cylindrical case 13'. A switch valve 29 is attached to the upper end of the main-body block 12, with the leading end of a spool 29a thereof pierced through the cylinder cover 7b closing the upper end of the actuating cylinder 6 and then thrust downwardly to a small depth into the actuating cylinder 6. When necessary, the main-body block 12 may be sealed with a head cover 30 and the end face of the cavity 14' defined by the lateral walls 14 may be closed with a lid plate 31. The support pieces 19 serving to nip from the opposite sides the flange of the frontmost rivet 1 pushed out by the feed claw 17 into the feed position are desired to be connected to each other through a spring 19a so that, after the support pieces 19 are opened by the cam 21 in downwardly diverged directions and then lifted, the spring 19a will cause them resume their condition for nipping the next rivet quickly and reliably. The holder tube 20 is passed through the lower guide cylinder 12b upwardly from the lower end thereof. The spring 20' is fitted around the periphery in the upper end portion of the holder tube 20 and a washer 20a is set to fasten the upper end of the spring 20' in position and a clip 20b is fitted on the washer 20a to prevent the spring from slipping out downwardly.

Figure 14:
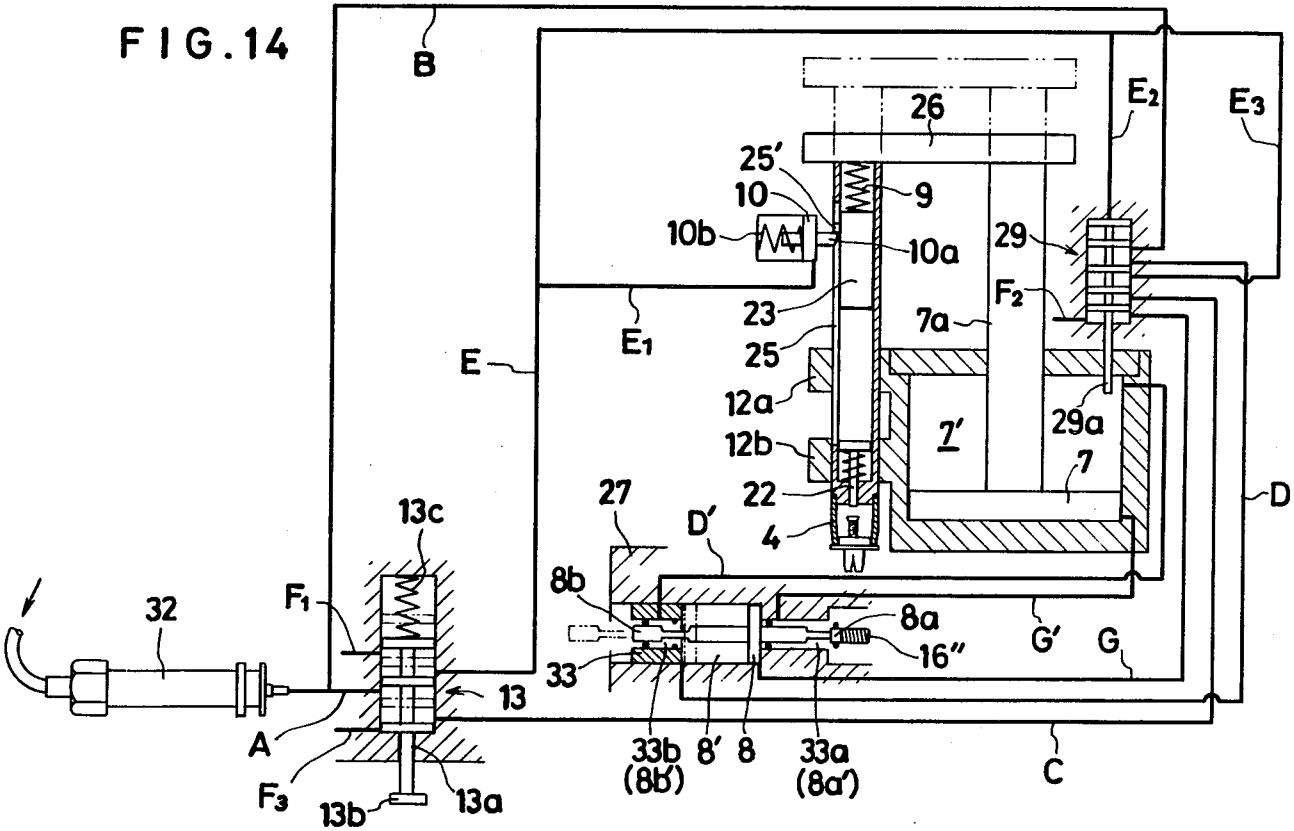
FIG. 14 is a diagram illustrating the circuit for the flow of pressurized fluid in the rivet driver.

As described above, the rivet driver of the present invention is provided with the main piston 7 serving to confer a vertical motion to the actuating cylinder 6, the combination feed piston and switch valves 8, 8a, 8b serving to advance the row of rivets, the striker piston 10, the operating valve 13, and the switch valve 29 having the end of the spool thereof thrust downwardly into the main cylinder. These component parts are connected as illustrated in FIG. 14 with ports formed inside the main-body block 12, the rivet case 27, and the switch valve 29. The valves operate their respective pistons under the pressure of a fluid, pnuematic pressure in the illustrated embodiment, as described below.

Figure 6:
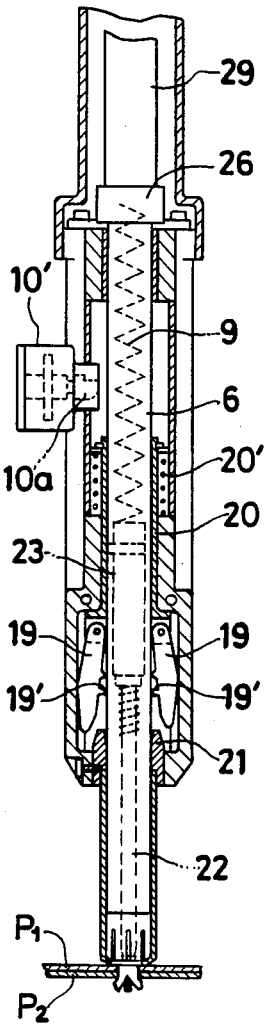
FIG. 6 is a cross-sectional front view illustrating the rivet driver of FIG. 4 after having driven a rivet to fasten two panels.

When the rivet driver is in the state illustrated in FIG. 5, the main piston 7 has completed its descent and consequently the actuating cylinder 6 has similarly completed its descent and the chuck 4 has caused the rivet to protrude outwardly from the lower end of the guide cylinder 11. The pin 25' of the upper hammer lever 23, however, is caught on the striker 10a and kept halfway along the interior of the actuating cylinder 6 and the upper end of the actuating cylinder 6 keeps the spring 9 compressed on the upper end of the upper hammer lever 23. Compressed air, as from an air compressor, is advanced to a nipple 32 attached to the interior of the grip 28 and thence fed as branched to the operating valve 13 through a feed line "A" and to the switch valve 29 through the feed line "B" and associated ports. The portion of the compressed air which has been advanced to the operating valve 13 is forwarded through the line "C" to the switch valve 29. In this case, since the spool 29a of the switch valve 29 is kept in its raised state, the compressed air ceases its flow on entering the valve. The portion of the compressed air which has been advanced to the switch valve 29 enters the left chamber of the cylinder 8' of the feed piston 8 because the switch valve 29 communicates with the line "D" leading to the left end of the cylinder 8'. The compressed air in the left chamber of the cylinder 8' keeps the feed piston 8 pressed toward the right and, at the same time, flows via the portion 8b' of a smaller diameter of the piston rod 8b and the line "D'" leading to the upper end of the main cylinder and enters the upper chamber of the main cylinder to press the main piston 7 downwardly. Thus, not only when the rivet is driven with the lower end of the actuating cylinder directed downwardly but also when the rivet is driven with the lower end of the actuating cylinder directed laterally or upwardly, the main piston 7, the actuating cylinder 6, and the feed piston 8 will not be moved. The spool 29a of the switch valve 29 divides the interior of the valve into a multiplicity of chambers with a multiplicity of flanges each intimately enclosed with an O-ring. The spool 29a, therefore, retains its raised state or lowered state by virtue of the friction generated between the O rings along the boundaries of the flanges and the inner wall of the valve.

In the state assumed as described above, the female tube 2 of the rivet 1 is inserted through the coinciding holes formed each in the superposed panels $P_1$, $P_2$ until the lower surface of the flange is pressed against the upper panel and a push button 13b at one end of a spool 13a of the operating valve projected downwardly near the grip 28 is forced in against the resistance of a spring 13c. Consequently, the operating valve 13 is switched and the line "A" connected with the operating valve is allowed to communicate with the line "E" within the valve chamber so that the compressed air is advanced as branched to the first branched line "$E_1$" serving to retract the striker piston 10 against the pressure of the spring 10b, the second branched line "$E_2$" serving to push the spool 29a of the switch valve 29 downwardly, and the third branched line "$E_3$" leading to the switch valve 29. Since the piston 10 consequently retracts the striker 10a (FIG. 6), the upper hammer lever 23 which has had its pin hooked on the striker 10a is propelled down the interior of the actuating cylinder at a high speed owing to the force of the spring 9, throws the lower hammer lever 22 impulsively downwardly against the resistance of the spring 22', and drives the male shank 3 of the rivet 1 into the female tube 2. The compressed air which has flowed through the second branched line "$E_2$" turns the spool 29a of the switch valve 29 downwardly and switches the switch valve 29, with the result that the line "B" which has so far kept the main piston pushed down via the line "D" becomes inactive within the switch valve. Nevertheless, since the third branched line "$E_3$" comes to communicate with the line "D", the downward pressing of the main piston 7 via the line "D'" will be continued. Thus, the feed piston and the main piston continue to remain motionless.

After the rivet 1 has been driven through the superposed panel and the finger tip is removed from the push button 13b, the spool 13a is pushed back to its original position by the spring 13c and the operating valve 13 is switched and the line "E" is allowed to communicate with the escape line "$F_1$" within the operating valve 13 and the striker piston 10 is pushed back to its original position by the spring 10b while expelling the compressed air through the lines "$E_1$, "E", and $F_1$". The line "A" which reaches the operating valve 29 again communicates with the line "C" which leads to the switch valve 29. This time, the spool 29*a* of the switch valve assumes its lowered position and connects the line "C" to the line "G" which leads to the right end of the cylinder 8' of the feed piston 8. Consequently, the compressed air flows from the operating valve to the lines "C" and "G" and then enters the right end of the cylinder 8' and the feed piston 8 advances to the left and causes the slider 16 and the feed claw 17 to be retracted. In this case, since the line "D" which reaches the left end of the cylinder 8' is allowed by the descent of the spool to communicate with the line "$E_3$" within the switch valve 29, the compressed air in the left chamber of the cylinder 8' is expelled successively through the lines "D", "$E_3$", "E" and "F".

At the end of the advance of the feed piston 8 to the left, the portion 8*a'* of a smaller diameter of the piston rod 8*a* communicates with the cylinder interior and allows the compressed air within the right chamber of the feed cylinder to flow to the line "G'" which communicates with the lower end of the main cylinder 7', with the result that the main piston begins to rise as accompanied by the actuating cylinder 6. During this ascent of the main piston, the pin 25' of the hammer lever continues its upward motion by depressing the striker out of its path (FIG. 7).

To permit the ascent of the main piston 7, the compressed air in the upper chamber of the main cylinder 7' is forwarded through the line "D'" and released into the ambient air through the valve orifice to which the piston rod 8*b* of the feed piston 8 is fitted. To permit the descent of the main piston 7, the compressed air in the lower chamber of the main cylinder 7' is forwarded through the line "G'" and released into the ambient air through the valve orifice to which the feed piston 8*a* is fitted. For this purpose, there are provided valve orifices 33*a*, 33*b* which are allowed to communicate with the right end and the left end respectively of the feed cylinder 8' and to which the piston rods 8*a*, 8*b* are fitted. These valve orifices have O rings 33*a'*, 33*b'* fitted in the inner wall of the ends adjoining the feed cylinder 8' to seal the peripheries of the piston rods 8*a*, 8*b*. Further, the piston rods 8*a*, 8*b* have, slightly in front of the portions 8*a'*, 8*b'* of a smaller diameter, fitted thereon O rings 34*a*, 34*b* adapted to seal tightly the inner walls of the valve orifices. When the feed piston 8 is positioned at the righthand end of the cylinder 8' (as indicated by the solid line in FIG. 14), the O ring 34*a* on the right piston rod 8*a* slips out of the valve orifice 33*a* to expose the valve orifice 33*a* to the ambient air, whereas the O ring 34*b* on the left piston rod 8*b* remains inserted to a small depth in the valve orifice 33*b* and the portion 8*b'* of a smaller diameter establishes communication between the valve orifice 33*b* and the left chamber of the cylinder 8'. When the feed piston is positioned at the lefthand end of the cylinder 8' (as indicated by the dotted line in FIG. 14), the O ring 34*b* of the left piston rod 8*b* slips out of the valve orifice 33*b* and the O ring 34*a* on the right piston rod 8*a* remains inserted to a small depth in the valve orifice 33*a* and the portion 8*a'* of a smaller diameter establishes communication between the right chamber of the cylinder and the valve orifice 33*a*. One end of the line "G'" opens into the valve orifice 33*a* and one end of the line "D'" opens into the valve orifice 33*b*. In the present embodiment, the valve orifice 33*a* of the right piston rod 8*a* is formed in the rivet case 27 and the valve orifice 33*b* of the left piston rod 8*b* is formed in a member 33 fastened as stowed in the portion of the cylinder 8' elongated in the axial direction.

When the feed pistion 8 begins to advance to the left, therefore, the O ring 34*b* of the left piston rod 8*b* slips off the valve orifice 33*b* as described above and the line "D'" causes the upper chamber of the main cylinder 7' to open through the valve orifice 33*b* into the ambient air, rendering the main piston 7 ready to move upwardly. Toward the end of the lefthand advance of the feed piston 8, the O ring 34*a* of the right piston rod 8*a* tightly closes the outer end part of the valve orifice 33*a* and, at the same time, the part 8*a'* of a smaller diameter establishes communication between the right chamber of the feed cylinder 8' and the valve orifice 33*a*. Consequently, part of the compressed air which has been delivered through the line "G" to the right chamber of the feed piston and urges the feed piston to the left flows through the portion 8*a'* of a smaller diameter and the valve orifice 33*a* into the line "G'" and flows into the main cylinder 7' upwardly from the bottom thereof to urge the main piston 7 upwardly. The compressed air so far contained in the upper chamber of the main cylinder is discharged through the already established line "D'" and then through the valve orifice 33*b*.

Figure 15:
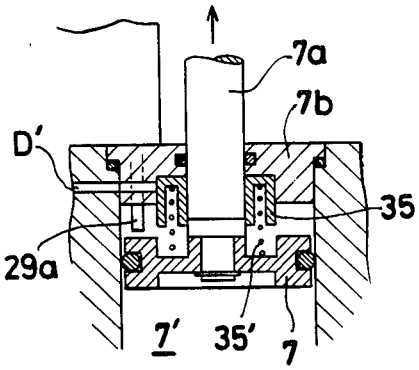
FIG. 15 is a cross-sectional view illustrating the rivet driver with the main piston near the top of its stroke.
Figure 16:
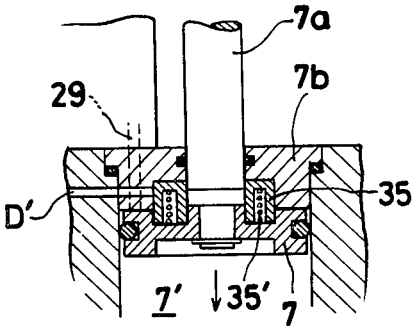
FIG. 16 is a cross-sectional view illustrating the main piston of FIG. 15 at the top of its stroke.

When the main piston 7 rises and completes its ascent, it pushes the spool 29*a* of the switch valve 29 upwardly and causes it to be switched to its raised position (FIGS. 15 and 16). Consequently, the lines "C" and "G" are cut off and the branched feed line "B" is allowed to communicate with the line "D" within the switch valve 29. The compressed air, therefore, flows into the lefthand end of the feed cylinder 8' and, at the same time, the line "G" is allowed to communicate with the escape line "$F_2$" within the switch valve 29.

The feed piston 8, therefore, advances to the right while urging the compressed air out of the right chamber into the lines "G", "$F_2$" and causes the slider 16 and the feed claw 17 to advance the row of rivets by one pitch, with the result that the frontmost rivet is pushed out into the feed position. When the feed piston 8 completes its leftward advance, the piston rod 8*a* situated to the right of the feed piston forces the O ring 34*a* out of the valve orifice 33*a* and opens the lower chamber of the main cylinder 7' through the line "G'" and the valve orifice 33*a* into the ambient air and, at the same time, the portion 8*b'* of a smaller diameter of the left piston rod 8*b* establishes communication between the left chamber of the feed chamber of the feed cylinder and the valve orifice 33*b* and the O ring 34*b* tightly closes the outer end of the valve orifice 33*b*. Consequently, the compressed air which has been introduced into the left chamber of the cylinder 8' through the line "D" and now urges the feed piston to the left flows through the line "D'" and enters the main cylinder 7' downwardly through the top thereof. Thus, the main piston 7 accompanied by the actuating cylinder begins to slide down while urging the compressed air out of the lower chamber of the cylinder into the line "G'" and the valve orifice 33*a*. After it has descended to some extent, the upper hammer lever 23 is stopped because the pin 25' gets caught on the striker 10*a*, while the remainder of the main piston 7 continues to go down. The upper end of the actuating cylinder 6 compresses the spring 9 on the upper hammer lever 23 and the chuck 4 at the lower end nips the frontmost rivet (FIG. 8), tears it off the row of rivets, and readies the rivet to be driven (FIGS. 4 and 5).

At this time, therefore, the operator is required to insert the row of rivets through the open end of the groove provided in the rivet case 27 into the grooves 15 formed on the lateral walls 14 of the main-body block 12 and, after the frontmost rivet has slid past the stopper 18, give one full push to the pushbutton 13*b* of the operating valve 13, causing the rivet driver to produce one idle driving motion thereby allowing the frontmost rivet to be supported by the pair of support pieces 19. Thereafter, the rivet driver is actuated to drive one rivet out of the row of rivets each time a push is given to the pushbutton 13*b*. This condition of the rivet driver continues until the supply of rivets runs out. Optionally, the valve chamber of the operating valve 13 may be provided at the lower end thereof with an air escape line "$F_3$" communicating with the ambient air so that when the pushbutton 13*b* is released by the finger, the spool 13*a* will expel the compressed air entrapped in the lower end of the chamber out of the air escape line "$F_3$" and then will be quickly and safely returned to its original condition by the spring 13*c*.

In accordance with this invention, the rivet driver, once charged with the row of rivets interlinked through the medium of their respective flanges, is actuated by the pressure of a fluid to drive one after another of these rivets smoothly and quickly and effect desired union of members without requiring any external force. While the main piston and the feed piston are in the process of being readied for their respective operations and when the striker piston is actuated to trigger the striker and drive the male shank into the rivet, the main piston is pressed down to keep the actuating cylinder in a lowered condition and the feed piston is retained in its advanced position to prevent the second and subsequent rivets from moving backwardly. Thus, the rivet driver can safely drive rivets even when the lower end of the actuating cylinder is held sideways or slightly upwardly instead of downwardly. Moreover, no erroneous operation can occur while the rivets are being forwarded or while the actuating cylinder is in the process of nipping the frontmost rivet and preparing it for transfer to the feed position because the main piston does not start ascending until the feed piston completes its backward motion, the feed piston does not start advancing and urging the row of rivets forward until the main piston completes its upward motion, and the main piston does not start descending until the feed piston completes its forward motion.

Where a buffer ring 35 having a slightly smaller diameter than the main piston 7 is slidably fitted around the rod 7*a* of the main piston and it is held up over the main piston 7 with a spring 35' as clearly illustrated in FIG. 15 and FIG. 16 and where this buffer ring 35 is adapted so that the upper side thereof first collides against the lower side of the cover 7*b* and, at the same time, the circumferential lateral surface thereof closes the opening of the port (line) "D'" communicating with the upper interior of the cylinder after the main piston completes its upward motion (FIG. 15), then the main piston starts ascending while compressing the spring 35' and compressing the air entrapped inside the upper interior of the main cylinder because of the closure of the line "D'". Thus, the upward motion of the main piston is retarded and effectively buffered. During the first part of the subsequent descent of the main piston, the lihe "D'" is closed by the buffer ring 35 and the fluid serving to force down the main piston is prevented from entering the upper interior of the cylinder. Consequently, the main piston is caused by its own weight and the elastic force of the spring 35' to move down slightly and then, accompanied by the buffer ring 35, to descend at a decreased rate of speed until the line "D'" is opened.

Owing to this arrangement, the chuck is not allowed to nip the frontmost rivet until after the slider 16 has safely advanced the rivet to the stated position. In other words, the provision of the buffer ring 35 and its attendant parts in the manner described above guarantees that the last part of the ascent of the main piston is safely buffered and the chuck never fails to nip the frontmost rivet during the descent of the main piston even when the ascent and descent of the main piston are effected at high speeds.

What is claimed is:

1. A rivet driver, comprising:

a main-body block containing a main cylinder, a main piston adapted to reciprocate inside said main cylinder upon the application of the pressure of a fluid, an actuating cylinder movably supported along the lateral side of said main-body block with the upper end thereof connected to the upper end of said main piston protruding from said main cylinder, provided in the longitudinal direction of the shell thereof with a slit, and adapted to reciprocate in conjunction with said main piston, a chuck formed at the lower end of said actuating cylinder and adapted to nip the flange of a rivet or the portion of a shank of said rivet protruding upwardly from said flange, a hammer lever accommodated within said actuating cylinder to reciprocate in conjunction with said actuating cylinder and adapted to have the lower end thereof deliver a downward stroke upon the male shank of the rivet nipped by said chuck, a spring contained within said actuating cylinder and positioned between the upper end of said hammer lever and the upper end of said actuating cylinder, a pin formed on the lateral surface of said hammer lever and projecting from said slit in said actuating cylinder, a striker adapted to allow the upward passage of said pin during the ascent of said hammer lever and said actuating cylinder but catch said pin and interrupt the descent of said hammer lever during the descent of said actuating cylinder together with said hammer lever thereby to cause the upper end of said actuating cylinder to contract said spring on the upper end of said pin, a piston for drawing said striker back from the position at which said striker catches said pin, an operating valve for actuating said piston by the pressure of a fluid, and a feed piston adapted to be actuated by the pressure of a fluid, upon completion of said ascent of said actuating cylinder, to urge the frontmost of a plurality of rivets arranged in a row to a position below said chuck at the lower end of said actuating cylinder.

2. A rivet driver according to claim 1, wherein said hammer lever comprises an upper hammer lever provided laterally on the periphery thereof with a pin and a lower hammer lever adapted to deliver a downward stroke upon the male shank of the rivet.

3. A rivet driver according to claim 1, wherein the main piston and the feed piston are correlated in such a manner that normally the main piston is held down in its lowered condition and the feed piston in its advanced condition wherein the frontmost of the plurality of rivets is pushed out under the pressure of a fluid and, once an operating valve for causing retraction of the striker is actuated, the feed piston starts moving backwardly, the main piston starts ascending upon completion of said backward motion of the feed piston, the feed piston starts advancing upon completion of said ascent of the main piston, and the main piston starts descending upon completion of said advance of the feed piston.

* * * * *